US006222504B1

(12) United States Patent
Oby

(10) Patent No.: US 6,222,504 B1
(45) Date of Patent: Apr. 24, 2001

(54) ADJUSTABLE ANTENNA MOUNT WITH ROTATABLE ANTENNA BRACKETS FOR PCS AND OTHER ANTENNAS

(75) Inventor: Lawrence R. Oby, Larkspur, CO (US)

(73) Assignee: Omnipoint Corporation, Bethesda, MD (US)

( * ) Notice: Subject to any disclaimer, the term of this patent is extended or adjusted under 35 U.S.C. 154(b) by 0 days.

(21) Appl. No.: 09/483,198

(22) Filed: Jan. 14, 2000

(51) Int. Cl.[7] ..... H01Q 1/12
(52) U.S. Cl. ..... 343/892; 343/890
(58) Field of Search ..... 343/890, 891, 343/892, 882; H01Q 1/12

(56) References Cited

U.S. PATENT DOCUMENTS

| | | | | |
|---|---|---|---|---|
| 3,318,561 | * | 5/1967 | Finke et al. | 343/890 |
| 4,468,671 | * | 8/1984 | Ellingson et al. | 343/890 |
| 4,654,612 | * | 3/1987 | Smith | 343/890 |
| 4,755,830 | * | 7/1988 | Plunk | 343/890 |
| 5,291,121 | * | 3/1994 | Tropper | 343/890 |
| 5,971,345 | * | 10/1999 | Khalaf | 343/890 |

* cited by examiner

*Primary Examiner*—Don Wong
*Assistant Examiner*—Hoang Nguyen
(74) *Attorney, Agent, or Firm*—Lyon & Lyon LLP

(57) ABSTRACT

The present invention comprises an antenna mount including at least a first anchoring portion having an open region formed therethrough wherein the open region is sized to accommodate a mounting structure such as a pole, mast, or other such structure. The antenna mount may include a locking device configured to releasably secure the antenna mount about a mounting structure disposed within the open region of the first anchoring portion. The locking device may comprise a first locking structure adjustably coupled to the anchoring portion, the first locking structure adjustable from a first position peripherally located with respect to a centerline of the open region to a second position adjacent the periphery of the open region, the first locking structure configured to releasably engage a mounting structure accommodated within the open region when the first locking structure is at the second position. The antenna mount also includes an antenna bracket comprising a first wall having an antenna engaging face and a second wall having a first face rotatably engaged to the first anchoring portion. An antenna mount as herein described thus provides an antenna mount suitable for installation on a variety of variously sized and configured mounting structures while allowing simple variable azimuth adjustment of patch or panel type antennas mounted to the antenna brackets.

15 Claims, 8 Drawing Sheets

ADJUSTABLE ANTENNA MOUNT WITH ROTATABLE ANTENNA BRACKETS FOR PCS AND OTHER ANTENNAS

FIELD OF THE INVENTION

The present invention pertains to antenna mounts including more particularly to adjustable antenna mounts having azimuth adjustable antenna brackets.

BACKGROUND OF THE INVENTION

Wireless communication systems most often employ the use of "cell" technology, where a base station or other transceiver is dedicated to a specific geographic area. After accessing a base station, wireless customers are then connected to a communications network, such as a publicly switched telephone network (PSTN) or a data network such as a corporate LAN.

To provide complete coverage over an entire metropolitan area or geographic region, base stations must be installed at frequent and regular intervals. The need for such a regular array of base stations often necessitates that they be placed in conspicuous locations.

Since communication base stations require an antenna system to transmit and receive information to and from a wireless customer, the antenna often needs to be placed where there are no obstructions that will interfere with its operation. Optimizing the antenna performance often requires placing the antenna on the side of a building or on top of a tall pole or mast. Particularly in urban settings, crowded geographic regions, and residential areas, the need to install a large number of base stations and their associated antennas is typically at odds with the desire of a municipality to reduce the clutter and obtrusiveness of industrial installations and unsightly electrical and communications equipment. Local municipalities may have strict zoning regulations which can interfere with or even prohibit a communications company from installing wireless equipment in a location that interferes with the aesthetic characteristics of the city or town. To operate at optimum effectiveness, a direct line of site between the antenna and the communications device is preferred. This usually requires a conspicuous installation.

Antennas associated with communications systems may sometimes require field adjustments so that the directivity of the antenna can be modified to optimize its performance. New structures, additional base stations, or changing electromagnetic interference can alter the performance of an antenna system, requiring the orientation of an antenna to be changed from time to time. Consequently, it is beneficial to install an antenna so that the orientation of the antenna can be altered quickly and with minimum effort.

Known pole antenna mounts do not address the need to adjustably mount multiple antennas in an unobtrusive and inconspicuous manner. Known antenna mounts are fixed and are only suitable for a limited number of antennas. Since they are fixed, they fail to provide the necessary adjustability required by the changing environment and demands under which they must operate. Thus, it would be desirable to have an antenna mount suitable for the unobtrusive installation of multiple antennas. It would also be desirable for the antennas to be adjustably mounted, particularly so that the azimuth angle of the antenna may be easily and expeditiously adjusted to a wide variety of angles. Finally, it would be desirable to have a universal antenna mount which can be mounted on variously sized and/or configured mounting structures, including poles, towers, and beams.

SUMMARY OF THE INVENTION

The present invention solves the foregoing problems by providing an antenna mount that unobtrusively mounts one or more antennas to a variety of variously sized and configured mounting structures while allowing azimuth adjustment of the antennas.

One embodiment of the present invention is an antenna mount comprising an anchoring portion and an antenna bracket. The antenna bracket is adjustably engaged to the anchoring portion to allow azimuth adjustment of the antenna bracket relative to the anchoring portion. The antenna mount may include a locking device which enables the antenna mount to be releasably mounted about a mounting structure disposed within an open region provided within the anchoring portion of the antenna mount. Preferably, the antenna mount of the present invention is configured to be suitable for installation on mounting structures having a variety of cross-sectional configurations.

The antenna mount may also include a number of additional antenna brackets suited for mounting a plurality of antennas. In this manner, the antenna mount can be used to provide antenna coverage in multiple directions relative to the antenna mount.

DETAILED DESCRIPTION OF THE FIGURES

Figure 1:
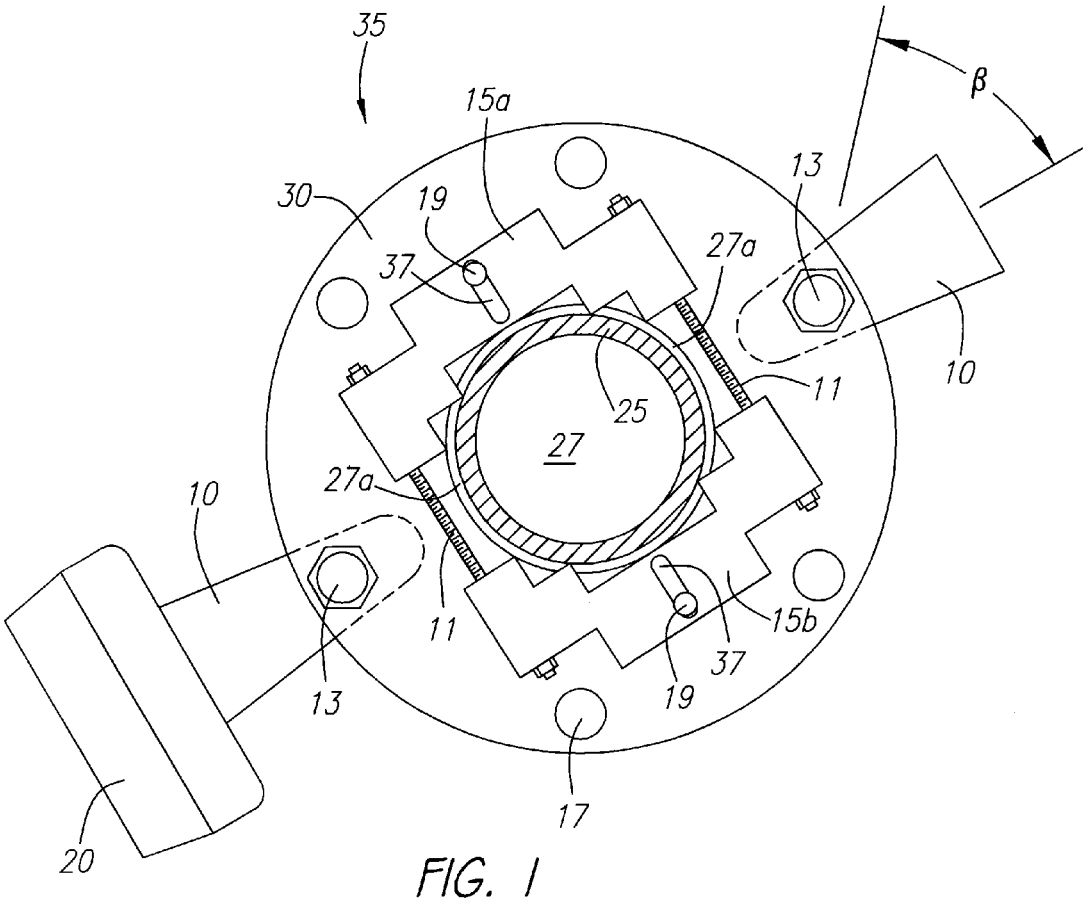
FIG. 1 is a plan view of an antenna mount of the present invention installed about a mounting structure.

FIG. 1 shows an antenna mount 35 of the present invention comprising an anchoring portion 30 to which is rotatably secured one or more antenna brackets 10 suitable for mounting a panel-type antenna 20. The anchoring portion 30 of FIG. 1 includes an open region 27 which can accommodate variously sized and configured mounting structures such as a mounting structure 25. In this instance, the open region 27 of the anchoring portion 30 is slightly larger than the mounting structure 25 which results in a slight relief 27*a* between a perimeter of the open region 27 and an outer circumference of the mounting structure 25.

To install an antenna mount 35 on differently sized and configured mounting structures such as the mounting structure 25, the antenna mount of FIG. 1 preferably includes first and second locking structures 15*a* and 15*b* which cooperate to releasably secure the mounting structure 25 disposed within the open region 27. In this embodiment, the locking structures 15*a* and 15*b* are interconnected with threaded bolts 11 which are tightened to move the locking structures 15*a* and 15*b* radially inward relative to the centerline of the open region and loosened to move the locking structures 15*a* and 15*b* radially outward to a peripheral position adjacent the periphery of the anchoring portion. The locking structures 15*a* and 15*b* are slidably coupled to the anchoring portion 30 and include a slot 37 which accommodates a bolt 19. When tightened, bolt 19 prevents the locking structures 15*a* and 15*b* from moving relative to the anchoring portion 30. When loosened, bolt 19 allows the locking structures 15*a* and 15*b* to slide radially to accommodate differently sized and configured mounting structures 25 disposed within the open region 27.

The antenna mount 35 of FIG. 1 includes one or more antenna brackets 10 which are each configured to mount an antenna. As an example, FIG. 1 shows a panel antenna 20. As shown in FIG. 1, antenna brackets 10 are mounted to the anchoring portion 30 through holes 17 formed around the periphery of the anchoring portion 30. Although only two antenna brackets 10 are shown mounted to the anchoring portion 30 in FIG. 1, in a preferred embodiment, multiple antenna brackets are utilized to increase the antenna coverage possible from a single antenna station. For example, the antenna mount 35 of FIG. 1 can easily accommodate six antennas 20.

The antenna brackets 10 illustrated in FIG. 1 are mounted and configured to allow azimuth adjustment of the antenna 20 relative to the anchoring portion 30. Preferably, a hinge-bolt 13, or other fastening device, rotatably secures the antenna bracket 10 to the anchoring portion 30. Hinge-bolt 13 is tightened to secure the antenna bracket 10 in a particular angular orientation. The hinge-bolt 13 is loosened as desired to allow reorientation of the antenna bracket 10. With the antenna bracket configuration shown in FIG. 1, the angle of azimuth, designated $\beta°$, may be varied from 0° to 90° or from 0° to −90° for at least 180° of total azimuth angle adjustment. Depending on the degree of adjustability desired, the antenna brackets 10 may be configured to allow a lesser degree of adjustment with a corresponding decrease in the profile of the antenna bracket 10 relative to the anchoring portion 30.

Figure 2:
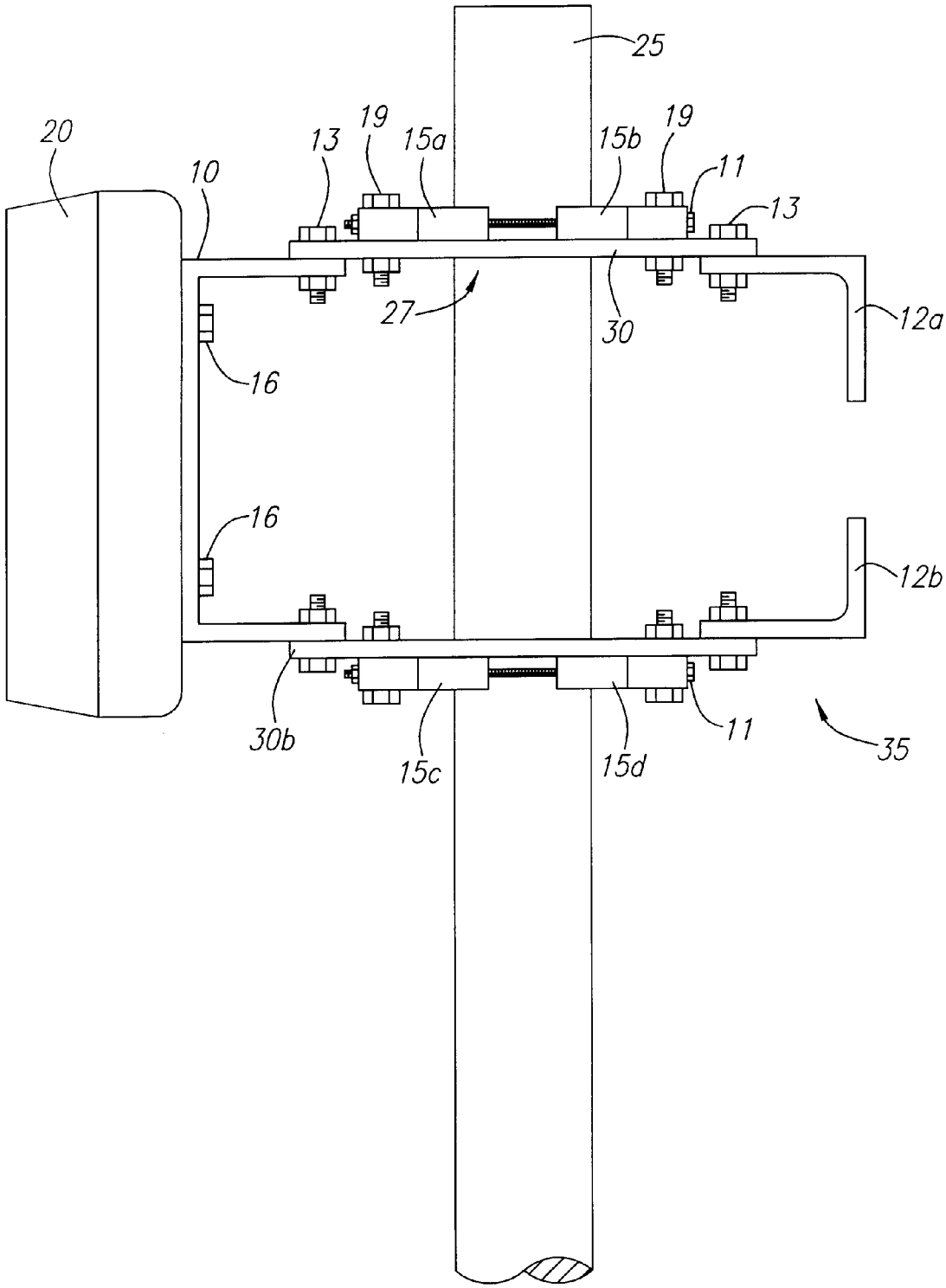
FIG. 2 is an elevational view of an antenna mount of the present invention installed about a mounting structure.

FIG. 2 is an elevational view of an antenna mount 35 of the present invention installed about a mounting structure 25. As shown in FIG. 2, the antenna mount 35 may include a second anchoring portion 30*b* to increase the structural integrity of the antenna mount 35. The second anchoring portion 30*b* is maintained in a spaced facing relationship relative to the first anchoring portion 30. The distance between the first and second anchoring portions 30 and 30*b* is largely dictated by the size of the antenna 20 that is desired to be mounted. FIG. 2 shows alternative configurations for mounting the antenna to the first and second anchoring portions 30, 30*b*. For example, the rightmost antenna bracket arrangement for mounting an antenna 20 comprises first and second antenna brackets 12*a* and 12*b* which are preferably configured in an "L"-shape. Antenna bracket 12*a* includes a first wall corresponding to the base of the "L" wherein the first wall includes an antenna engaging face which is configured to secure an antenna such as a panel antenna 20. Antenna bracket 12*a* includes a second wall corresponding to the leg of an "L" wherein the second wall includes an anchoring face that engages with the first anchoring portion 30. The antenna bracket 12*a* is preferably rotatably engaged to the first anchoring portion 30 with a hinge-bolt 13 as previously described so that the first face rotatably engages the first anchoring portion 30. Similarly, antenna bracket 12*b* includes third and fourth walls, the third wall having a second face that engages with the second anchoring portion 30*b* described above.

Alternatively, the left most antenna bracket arrangement of FIG. 2 preferably comprises a single "U"-shaped antenna bracket which has first and second walls corresponding to the legs of the "U" and a third wall corresponding to the base of the "U." The first wall includes a first face that engages with the first anchoring portion 30 and which is rotatably engaged to the first anchoring portion 30 with a hinge-bolt 13. Similarly, the second wall includes a second face which is rotatably engaged to the second anchoring portion 30*b* with a hinge-bolt 13. Finally, the third wall includes an antenna engaging face adapted to secure an antenna 20 using fasteners 16 or other known fasteners.

One advantage of the "L"-shaped antenna brackets 12*a* and 12*b* shown in FIG. 2 is that they are readily adaptable to a variety of antenna sizes and configurations. For example, merely widening the distance between the first and second anchoring portions, 30 and 30*b*, allows the antenna brackets to be used on much larger antennas 20 than are shown in FIG. 2. However, the "U"-shaped antenna bracket 10 shown in FIG. 2 offers advantages over the "L"-shaped antenna bracket because it is considerably easier to manufacture and install and provides greater structural integrity. But the "U"-shaped antenna bracket may not be suitable for use with much larger or much smaller antennas because its length cannot be varied. Regardless, the preference of the designer will control the type and configuration of antenna bracket most suitable for fixing the antenna to the antenna mount.

As shown in FIG. 2, the antenna mount 35 preferably includes a second pair of locking structures 15*c* and 15*d* which are slidably coupled to the second anchoring portion 30*b* as described above in regards to locking structures 15*a*, 15*b*. Locking structures 15*c* and 15*d* may also be coupled to the opposite face of the second anchoring portion 30*b* or they may be omitted entirely depending on whether there is a need for additional locking force for securing the antenna mount 35 to the mounting, structure 25.

Although FIG. 2 only illustrates a single antenna 20 mounted to the antenna mount 35, preferably the antenna mount 35 is configured to have a plurality of antenna brackets installed about the periphery of the first and second anchoring portions 30 and 30*b* in order to secure multiple antennas.

Figure 3:
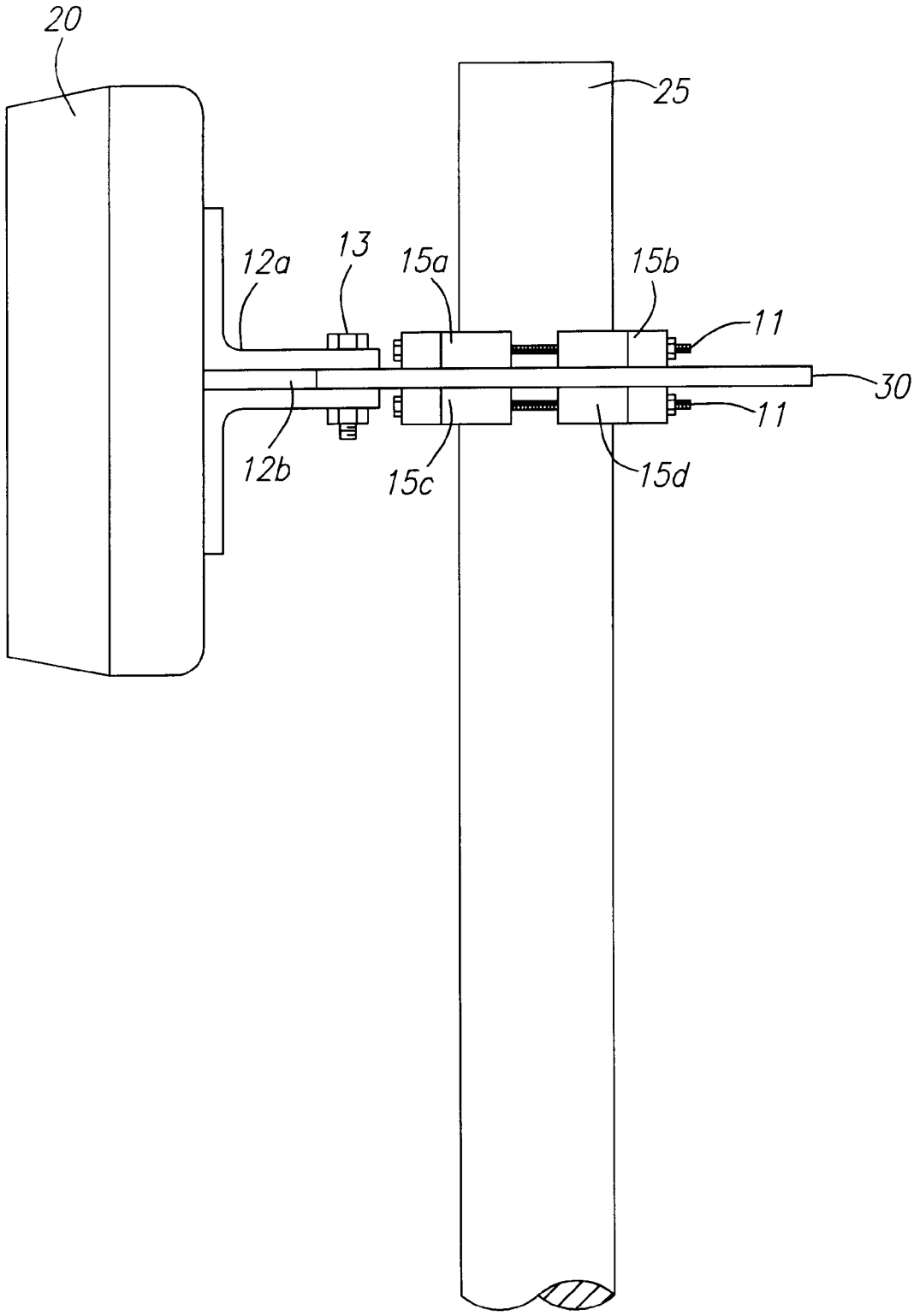
FIG. 3 is an elevational view showing an alternate embodiment of an antenna mount of the present invention installed about a mounting structure.

FIG. 3 shows another alternative embodiment of the antenna mount in accordance with the present invention installed about a mounting structure 25. The antenna mount 35 comprises a first anchoring portion 30 and brackets 12*a* and 12*b* secured to the first anchoring portion. The mounting structure 25 is disposed within an open region (not visible) provided within the first anchoring portion 30 and is then locked in place with locking structures 15*a* and 15*b* as previously described. Additionally, a second set of locking structures 15*c* and 15*d* may be slidably coupled to an opposite face of the first anchoring portion 30 to further secure the first anchoring portion 30 to the mounting structure 25.

The antenna mount 35 of FIG. 3 includes a pair of "L"-shaped antenna brackets 12*a* and 12*b*, previously described, which have been reversed from the orientation shown in FIG. 2 for use with a single anchoring portion 30. A hinge-bolt 13 or other similar hinge-fastener is used to rotatably secure the antenna brackets 12*a* and 12*b* to the anchoring portion 30.

A particular advantage of the present invention is the adaptability of an antenna mount for use with a variety of mounting structures having various sizes and configurations. For example, FIG. 4 illustrates an alternative configuration of the open region 27 which allows for the antenna mount 35 to be installed on a mounting structure without the need to insert a free end of the mounting structure through the open region.

Figure 4:
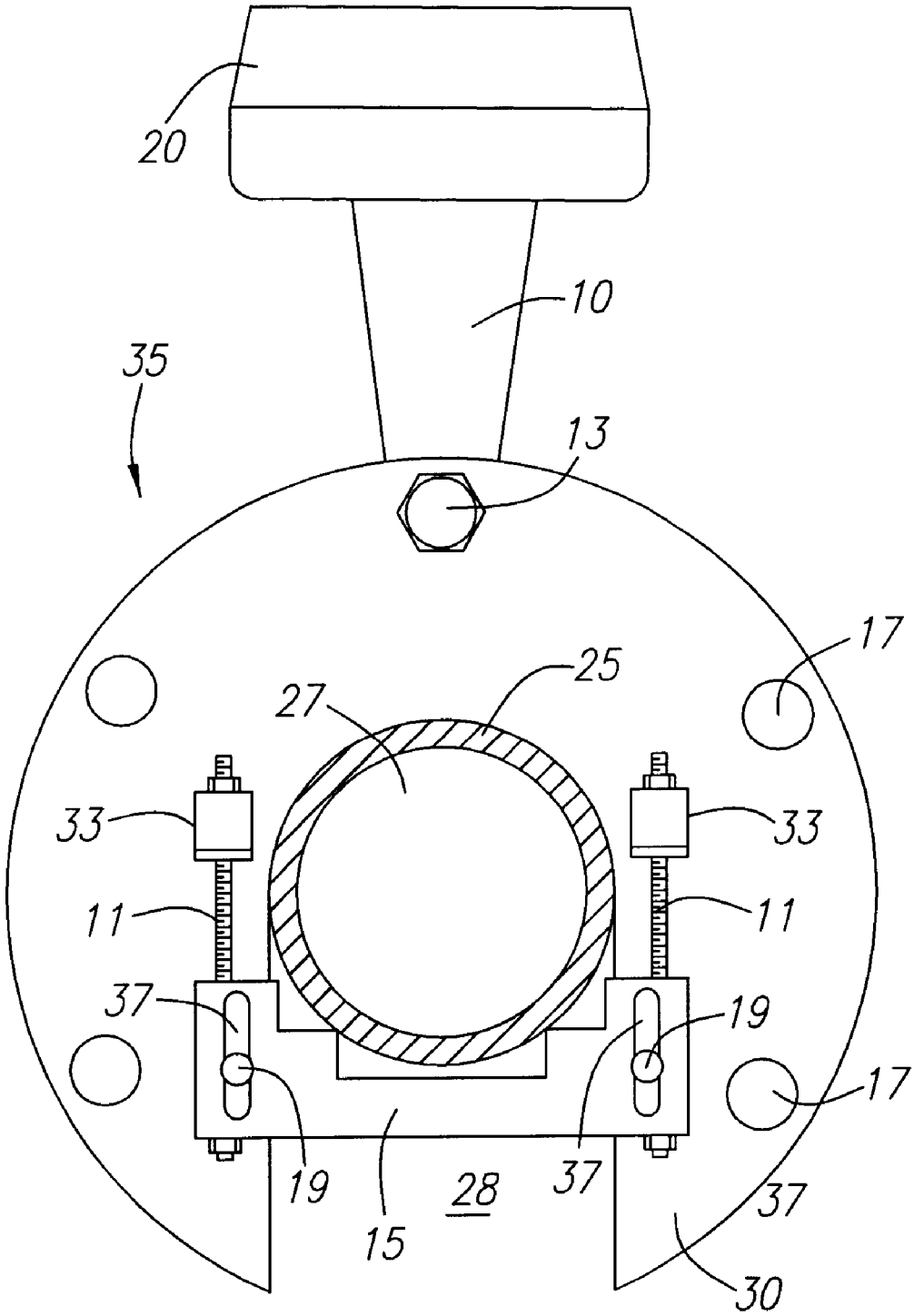
FIG. 4 is a plan view showing a second alternate embodiment of an antenna mount of the present invention.

The configuration shown in FIG. 4 is particularly useful if the antenna mount 35 is to be installed on an existing structure. For example, an antenna mount may need to be installed on a preinstalled pole, such as a telephone pole, that is extremely tall, rendering it difficult to place the antenna mount over the free end of the pole. Also, the pole may have existing installations at its free end which may render it difficult or impossible to pass the free end through the open region 27 during installation. Likewise, installation on the leg of a tower, tree limb, or other similar structure may be impossible with an open region such as shown in FIG. 1.

The open region 28 of FIG. 4 comprises a slot from the periphery of the anchoring portion 30 to the center of the anchoring portion. During installation, with the locking structure 15 removed, a mounting structure 25 is passed through the slot 28 until the mounting structure 30 seats securely within the closed end of the slot 28. A locking structure 15 is then installed using threaded bolts 11 which are threaded through the locking structure 15 and into threaded female fasteners 33 fixed to the first anchoring portion 30. These bolts 11 are securely tightened, locking the pole between the closed end of the slot 28 and the locking structure 15. A pair of mounting bolts 19 may also be installed in slots 37 provided within the locking structure in order to secure the locking structure 30 to the anchoring portion 15. Alternatively, a cooperating tongue-and-groove or dovetail antenna mount (not shown) may be used to slidably couple the locking structure 15 with the anchoring portion 30.

The threaded female fasteners 33 of FIG. 4 may also be replaced with a second locking structure to create a locking assembly similar to that shown and described in FIG. 1. In this manner, additional locking force is created by the use of two locking structures cooperating together.

Figure 5A:
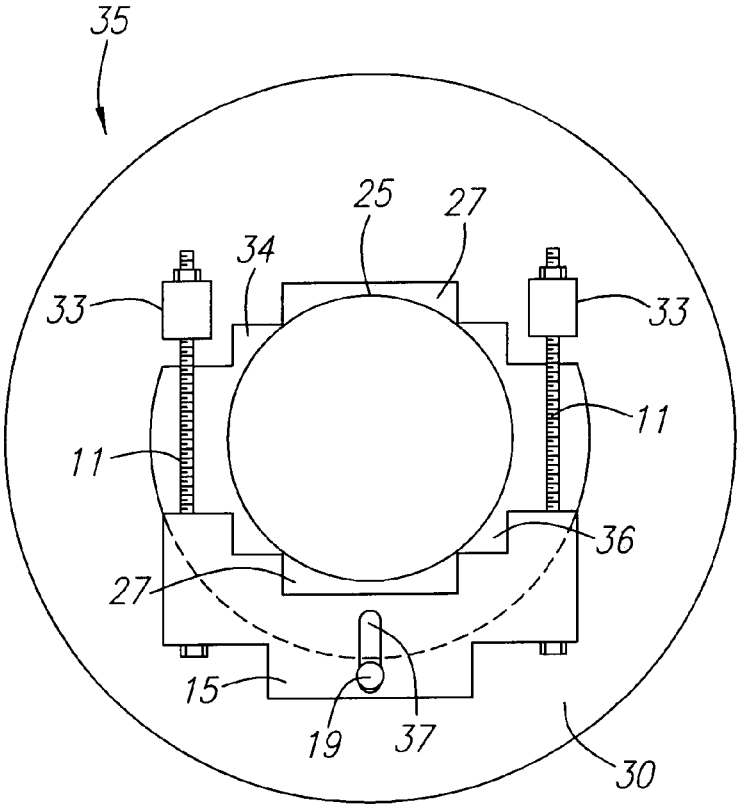
FIGS. 5A and 5B are plan views of a third alternate embodiment of the present invention.
Figure 5B:
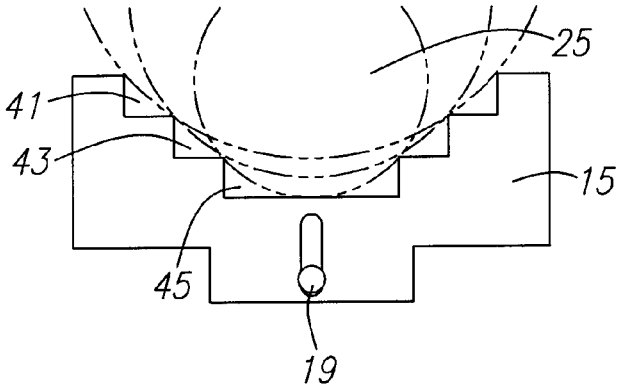

FIG. 5*a* illustrates an alternative configuration of an antenna mount 35 of the present invention having an open region 27 which is shaped to cooperate with a single locking structure 15 to lock the antenna mount 35 about a mounting structure 25. As shown in FIG. 5, the open region has a semi-circular portion 36 and a stepped portion 34, wherein the stepped portion 34 has a number of right angle corners. FIG. 5*b* shows a locking structure 15 which is configured having a number of right angle corners created by cut-out portions 41, 43, and 45.

FIG. 5*b* graphically illustrates how the locking structure 15 engages various sized poles or mounting structures 25. As the locking structure 15 is tightened using bolts 11, the mounting structure 25 butts up against the corners created by cut-out portions 41, 43, 45 and is locked down against these corners. Similarly, as the locking structure 15 of FIG. 5*a* is tightened, the mounting structure 25 butts up against the right-angle corners of the stepped portion 34 of the open region 27. The mounting structure 25 is thus locked against both the corners of the locking structure 15 and the corners of the stepped portion 34 of the open region 27. As shown in FIG. 5*b,* the corners against which the mounting structure 25 butts against depends on the size of the mounting structure 25. The larger the mounting structure 25, the wider the set of corners against which the structure 25 will butt.

Once the bolts 11 have been sufficiently tightened to securely lock the antenna mount 35 about the mounting structure 25, bolt 19 may be tightened to secure the locking structure 15 relative to the first anchoring portion.

It can be seen that the open region 27 of FIG. 5*a* may also be configured having a slot as described above in regards to FIG. 4 which allows the antenna mount 35 to be installed on a mounting structure 25 without the need to pass the antenna mount 35 over a free end of the mounting structure 25.

Figure 6:
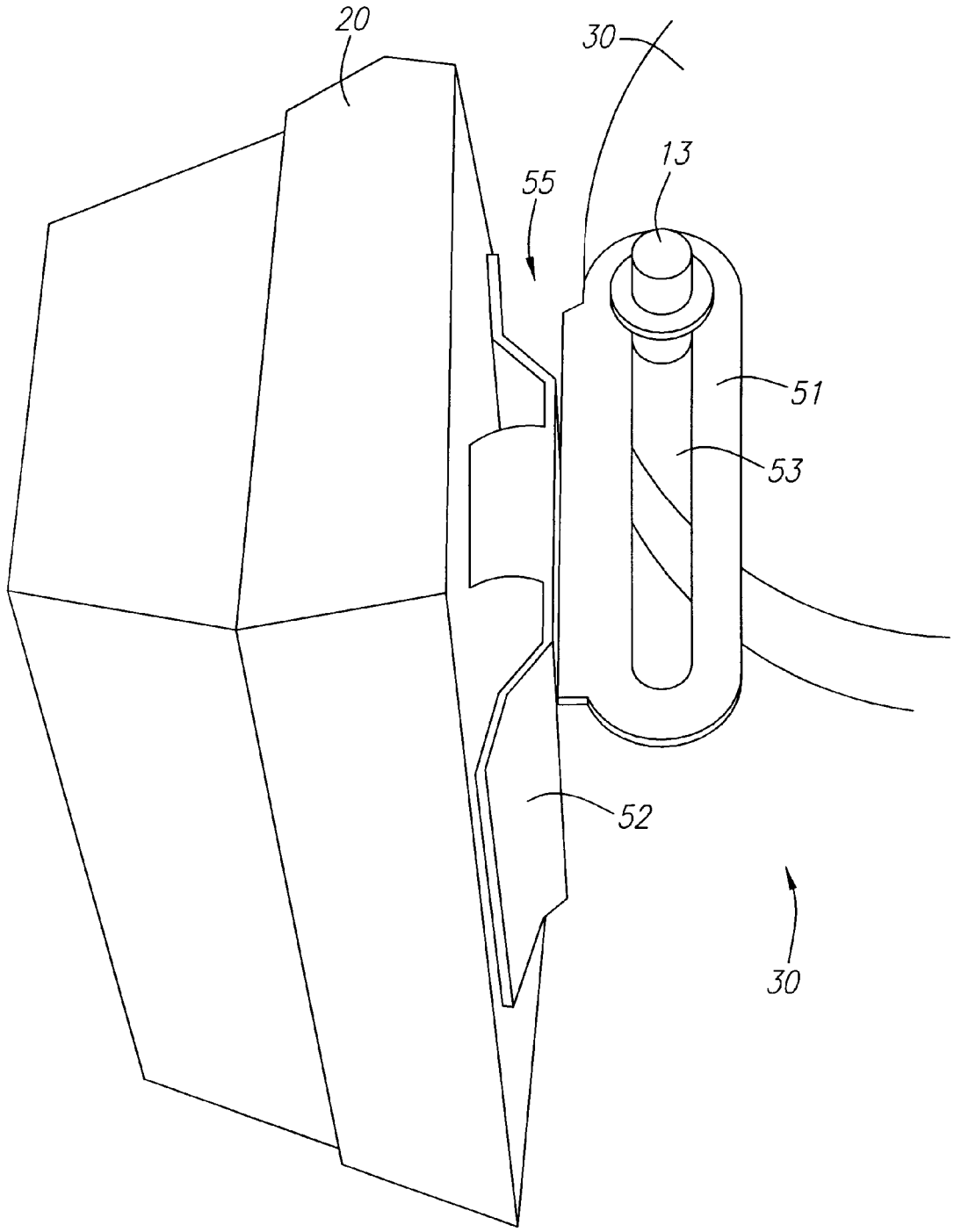
FIG. 6 is a further alternative embodiment of an antenna bracket of the present invention.

FIG. 6 shows an alternative configuration of an antenna bracket 55 of the present invention, which is more fully described and disclosed in application Ser. No. 09/438,215, filed Jan. 14, 2000, the disclosure of which is incorporated herein by reference in its entirety. The antenna bracket 55 of FIG. 6 includes a mounting plate 52 which is configured to be secured to an antenna 20 such as shown in FIG. 6. Further, the antenna bracket 55 has a slide wall 51 including a lengthwise channel therethrough which slidably and rotatably engages the first anchoring portion 30. A clampable pivoting, slide mechanism rotatably and slidably couples the antenna bracket 55 to the first anchoring portion 30.

A particular advantage of the antenna bracket configuration shown in FIG. 6 is that it allows rotatable coupling of an antenna to the anchoring portion 30 in a very low-profile design while permitting approximately 180° of full rotation of the antenna bracket relative to the anchoring portion 30. Multiple antennas may also be mounted at various locations around the periphery of the antenna mount 35 without interfering with the adjustability of an adjacent antenna.

It should be understood that the antenna mount of the present invention is easily configurable to be suitable for installation on mounting structures having a variety of cross-sectional configurations: round, square, "I"-shaped, etc. For example, the locking structures 15*a* and 15*b* shown in FIG. 1 are particularly suitable for mounting structures having a circular cross-sectional configuration. However, the "sawtooth" configuration of the locking structures 15*a* and 15*b* may be varied to allow the installation of the antenna mount 35 about alternatively configured mounting structures.

Figure 7A:
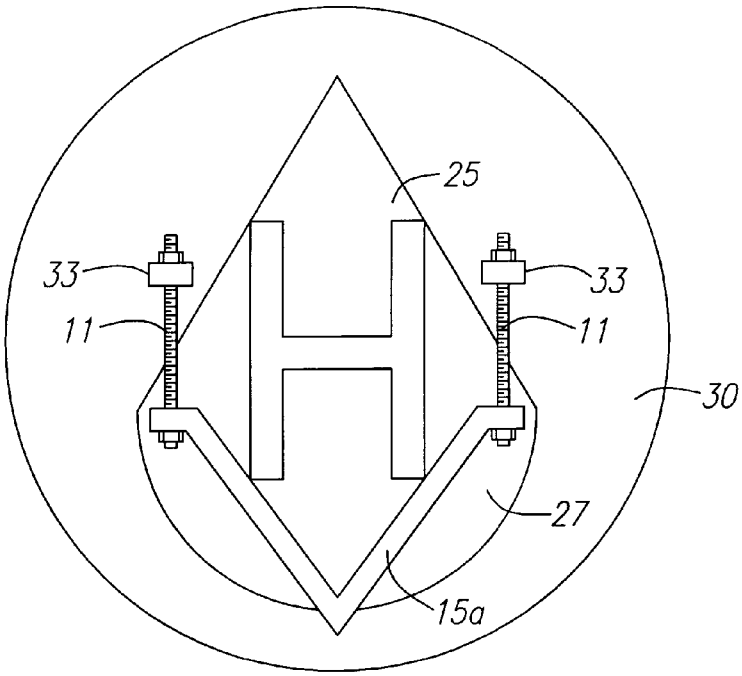
FIGS. 7A–7C show alternative embodiments of the antenna mount of the present invention.
Figure 7B:
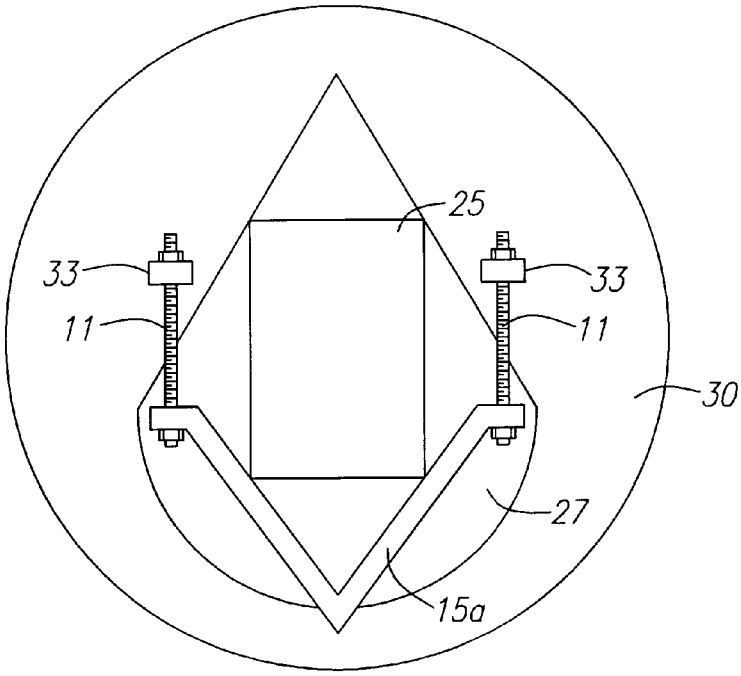
Figure 7C:
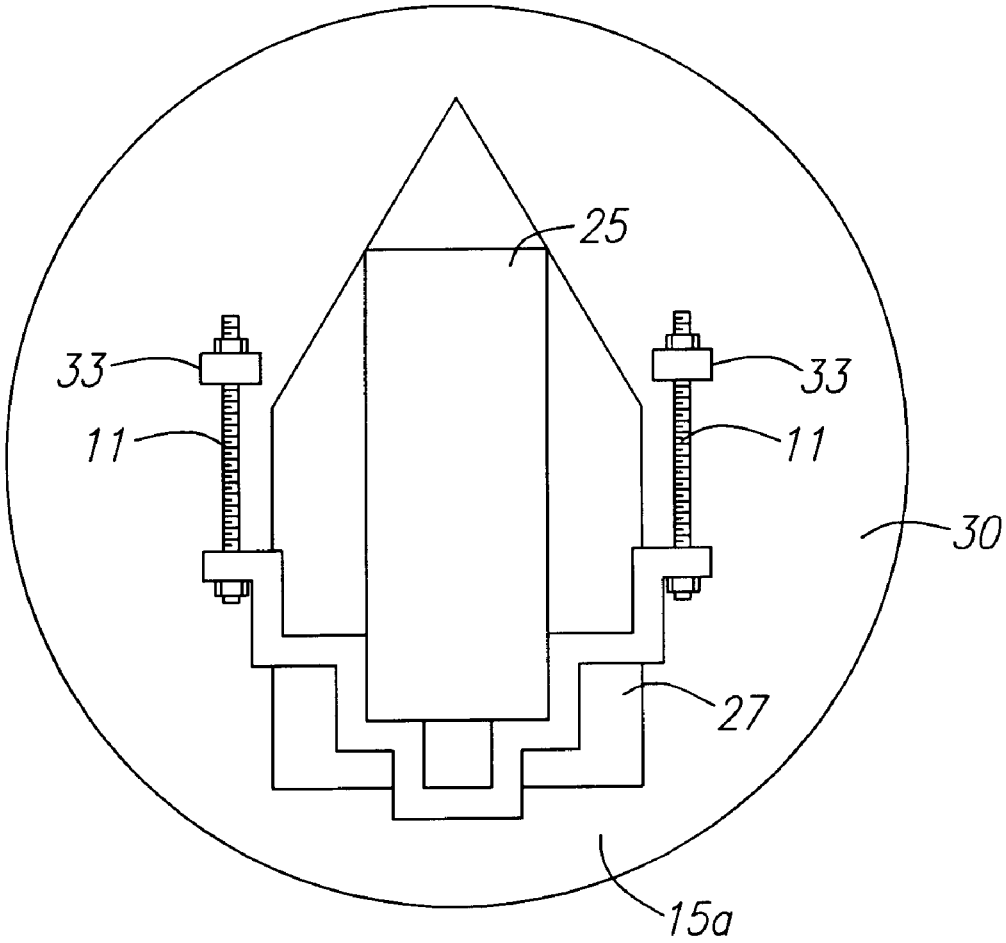

FIGS. 7(A–C) show alternative configurations for the locking device of the present invention. For example, FIG. 7A shows a "V"-shaped locking structure 15*a* which is used to lock the antenna mount 35 about an "I"-beam mounting structure 25. Alternatively, FIG. 7B shows a similar "V"-shaped locking structure 15*a* which is used to lock the antenna mount 35 about a square cross-section mounting structure 25. Further, an alternatively configured locking structure 15*a* is shown in FIG. 7C which is used to lock the antenna mount 35 about a wood beam mounting structure 25.

An adjustable antenna mount suitable for use with a variety of mounting structures has been herein shown and described. From the foregoing, it will be appreciated that although embodiments of the invention have been described herein for purposes of illustration, various modifications may be made without deviating from the spirit of the invention. It can also be understood by one of ordinary skill in the art that specific details of any embodiment herein described can be interchanged with or applied to the teachings of any other embodiment. Thus, the present invention is not limited to the embodiments described herein, but rather is defined by the claims which follow.

What is claimed is:

1. An antenna mount comprising:

a first anchoring portion having an open region formed therethrough, the open region sized to accommodate a mounting structure;

an antenna bracket comprising a first wall having an antenna engaging face and a second wall having an anchoring face rotatably engaged to the first anchoring portion; and a locking device configured to releasably secure the antenna mount about the mounting structure disposed within the open region of the first anchoring portion.

2. The antenna mount of claim 1 wherein the locking device is configured to adjust the open region from a first size to at least a second size.

3. The antenna mount of claim 2 wherein the locking device comprises a first locking structure adjustably coupled to the anchoring portion, the first locking structure adjustable from a first position peripherally located with respect to a centerline of the open region to a second position located adjacent the periphery of the open region, the first locking structure configured to releasably engage a mounting structure accommodated within the open region when the first locking structure is at the second position.

4. The antenna mount of claim 3 wherein the locking device includes a second locking structure adjustably coupled to the anchoring portion, the second locking structure adjustable from a third position peripherally located with respect to a centerline of the open region to a fourth position located adjacent the periphery of the open region, the second locking structure opposite the first locking structure relative to the open region, the second locking structure configured to releasably engage a mounting structure accommodated within the open region when the second locking structure is at the fourth position.

5. The antenna mount of claim 2 wherein the locking device is configured to adjust the open region from a first size to at least a second size.

6. The antenna mount of claim 1 wherein the antenna bracket is rotatable at least 180°.

7. The antenna mount of claim 1 further comprising:

a second anchoring portion maintained in a spaced facing relationship relative to the first anchoring portion; the second anchoring portion having an open region sized to accommodate a mounting structure forward therethrough; and a second antenna bracket comprising a first wall having an antenna engaging face and a second wall having a second face rotatably engaged to the second anchoring portion.

8. The antenna mount of claim 7 further comprising an antenna mounted to the antenna engaging face of the first antenna bracket and the antenna engaging face of the second antenna bracket.

9. The antenna mount of claim 1 further comprising a panel mounted to the antenna engaging face of the antenna bracket.

10. The antenna mount of claim 1 further including at least one additional antenna bracket, the at least one additional antenna bracket comprising a first wall having an antenna engaging face and a second wall having a first face rotatably engaged to the first anchoring portion.

11. The antenna mount of claim 1 wherein the second wall of the antenna bracket includes a channel formed therethrough, the channel formed substantially parallel to the first wall, wherein a pin is engaged within the elongate slot and fixed to the first anchoring portion so that the first face is rotatably and slidably secured to the first anchoring portion.

12. An antenna mount comprising:

a first anchoring portion having an open region formed therethrough, the open region sized to accommodate a mounting structure;

a second anchoring portion having an open region formed therethrough, the open region sized to accommodate a mounting structure, the second anchoring portion maintained in a spaced facing relationship relative to the first anchoring portion;

an antenna bracket comprising a first wall having an antenna engaging face, a second wall having a first face rotatably engaged to the first anchoring portion, and a third wall having a second face rotatably engaged to the second anchoring portion; and a locking device configured to releasably secure the antenna mount about the mounting structure disposed within the open region of the first anchoring portion.

13. The antenna mount of claim 12 wherein the antenna bracket is rotatable at least 180°.

14. The antenna mount of claim 12 further including at least one additional antenna bracket, the at least one additional antenna bracket comprising a first wall having an antenna engaging face, a second wall having a first face rotatably engaged to the first anchoring portion, and a third wall having a second face rotatably engaged to the second anchoring portion.

15. The antenna mount of claim 12 wherein the locking device comprises a first locking structure adjustably coupled to the anchoring portion, the first locking structure adjustable from a first position peripherally with respect to a centerline of the open region to a second position more proximate with respect to a centerline of the open region, the first locking structure configured to releasably engage a mounting structure accommodated within the open region when the first locking structure is at the second position.

* * * * *